US008976067B2

(12) United States Patent
Fischer

(10) Patent No.: US 8,976,067 B2
(45) Date of Patent: Mar. 10, 2015

(54) ANTENNA MODULE HAVING INTEGRATED RADIO FREQUENCY CIRCUITRY

(75) Inventor: Larry G. Fischer, Waseca, MN (US)

(73) Assignee: ADC Telecommunications, Inc., Berwyn, PA (US)

( * ) Notice: Subject to any disclaimer, the term of this patent is extended or adjusted under 35 U.S.C. 154(b) by 108 days.

(21) Appl. No.: 13/492,339

(22) Filed: Jun. 8, 2012

(65) Prior Publication Data

US 2012/0313821 A1 Dec. 13, 2012

Related U.S. Application Data

(60) Provisional application No. 61/495,235, filed on Jun. 9, 2011.

(51) Int. Cl.

| | |
|---|---|
| ***H01Q 1/38*** | (2006.01) |
| ***H01Q 9/04*** | (2006.01) |
| ***H01Q 9/28*** | (2006.01) |
| ***H01Q 21/28*** | (2006.01) |

(52) U.S. Cl.

CPC ..... *H01Q 9/0407* (2013.01); *H01Q 9/28* (2013.01); *H01Q 21/28* (2013.01)

USPC ..... 343/700 MS; 343/702; 343/795

(58) Field of Classification Search

CPC . H01Q 1/2225; H01Q 21/0065; H01Q 23/00; H01Q 9/16; H01Q 9/285

USPC ..... 343/700 MS, 702, 795

See application file for complete search history.

(56) References Cited

U.S. PATENT DOCUMENTS

| | | | | |
|---|---|---|---|---|
| 6,168,084 | B1 | 1/2001 | Mish | |
| 7,079,869 | B2 | 7/2006 | Aytur et al. | |
| 7,630,588 | B2 * | 12/2009 | Ouchi | 385/8 |
| 7,786,944 | B2 * | 8/2010 | Franson et al. | 343/770 |
| 2004/0056805 | A1 * | 3/2004 | Chen | 343/700 MS |
| 2007/0057861 | A1 * | 3/2007 | Forster et al. | 343/806 |
| 2007/0290925 | A1 | 12/2007 | Dijkstra | |
| 2008/0284662 | A1 * | 11/2008 | Yagi | 343/702 |
| 2011/0122037 | A1 | 5/2011 | Rofougaran et al. | |
| 2012/0062433 | A1 * | 3/2012 | Balanis et al. | 343/720 |

FOREIGN PATENT DOCUMENTS

WO 2011022101 2/2011

OTHER PUBLICATIONS

The International Bureau of WIPO, "International Preliminary Report on Patentability", "from PCT Counterpart of U.S. Appl. No. 13/492,339", filed Dec. 27, 2013, pp. 1-6, Published in: CH.

International Searching Authority, "International Search Report", "from Foreign Counterpart of U.S. Appl. No. 13/492,339", filed Jan. 22, 2013, pp. 1-9, Published in: WO.

(Continued)

*Primary Examiner* — Tan Ho

(74) *Attorney, Agent, or Firm* — Fogg & Powers LLC

(57) ABSTRACT

One embodiment is directed to an antenna module comprising integrated RF circuitry comprising at least one of a transmitter and a receiver. The module further comprises an antenna element operatively coupled to the integrated RF circuitry, the antenna element comprising first and second substantially co-planar portions. The integrated RF circuitry is disposed on an interior part of at least one of the first and second substantially co-planar portions. Other embodiments are disclosed.

29 Claims, 8 Drawing Sheets

(56) References Cited

OTHER PUBLICATIONS

Korean Patent Office, "Korean Office Action", "from Korean Counterpart of U.S. Appl. No. 13/492,339", filed Jun. 2, 2014, pp. 1-5, Published in: KR.

Korean Patent Office, "Office Action for KR Application No. 2013-7034420", "from Foreign Counterpart of U.S. Appl. No. 13/492,339", filed Sep. 15, 2014, pp. 1-13, Published in: KR.

Korean Patent Office, "Office Action for Application Serial No. 2013-7034420", "from Foreign Counterpart to U.S. Appl. No. 13/492,339", Dec. 9, 2014, pp. 1-7, Published in: KR.

* cited by examiner

ANTENNA MODULE HAVING INTEGRATED RADIO FREQUENCY CIRCUITRY

CROSS-REFERENCE TO RELATED APPLICATIONS

This application claims the benefit of U.S. Provisional Patent Application Ser. No. 61/495,235, filed on Jun. 9, 2011, which is hereby incorporated herein by reference.

BACKGROUND

U.S. Pat. No. 7,079,869, issued Jul. 18, 2006, and titled "COMMUNICATION SYSTEM TRANSMITTER OR RECEIVER MODULE HAVING INTEGRATED RADIO FREQUENCY CIRCUITRY DIRECTLY COUPLED TO ANTENNA ELEMENT" (also referred to here as the "'869 Patent") is hereby incorporated herein by reference.

The '869 Patent describes a radio frequency (RF) module that comprises integrated RF circuitry comprising at least one of a transmitter and a receiver, and an antenna element operatively coupled to the integrated RF circuitry. The antenna element comprises first and second substantially co-planar portions, each of said first and second substantially co-planar portions having an inner end and an outer end. The first and second substantially co-planar portions are arranged end-to-end with their respective inner ends proximate one another. The integrated RF circuitry is disposed substantially adjacent the respective inner ends of the first and second substantially co-planar portions of the antenna element.

However, the configuration of this module may not be suitable for all applications.

SUMMARY

One embodiment is directed to an antenna module comprising integrated RF circuitry comprising at least one of a transmitter and a receiver. The module further comprises an antenna element operatively coupled to the integrated RF circuitry, the antenna element comprising first and second substantially co-planar portions. The integrated RF circuitry is disposed on an interior part of at least one of the first and second substantially co-planar portions.

Another embodiment is directed to an antenna module comprising integrated RF circuitry comprising at least one of a transmitter and a receiver. The module further comprises an antenna element operatively coupled to the integrated RF circuitry, the antenna element comprising first and second substantially co-planar portions. Each of the first and second substantially co-planar portions has a first end and a second end. The integrated RF circuitry is disposed substantially adjacent to a region of the first substantially co-planar portion of the antenna element that does not include the respective first end of the first substantially co-planar portion of the antenna element.

Another embodiment is directed to an antenna module comprising a radio frequency transmitter, a radio frequency receiver, and an antenna element operatively coupled to the radio frequency transmitter and radio frequency receiver. The antenna element comprises first and second substantially co-planar portions. The radio frequency transmitter is operatively coupled to the first substantially co-planar portion of the antenna element. The radio frequency receiver is operatively coupled to the second substantially co-planar portion of the antenna element. Each of the first and second substantially co-planar portions have a first end and a second end. The first and second substantially co-planar portions are arranged end-to-end with their respective first ends substantially separated from one another within the antenna module.

Another embodiment is directed to an antenna module comprising integrated RF circuitry comprising at least one of a transmitter and a receiver. The module further comprises an antenna element operatively coupled to the integrated RF circuitry, the antenna element comprising first and second substantially co-planar portions. Each of the first and second substantially co-planar portions has a first end and a second end. The first and second substantially co-planar portions are arranged with their respective first ends proximate one another and offset from one another. The integrated RF circuitry is disposed substantially adjacent the respective first ends of the first and second substantially co-planar portions of the antenna element.

Another embodiment is directed to a radio frequency (RF) module for use in a communication device of a communication system. The module comprises integrated RF circuitry comprising at least one of a transmitter and a receiver. The module further comprises an antenna element operatively coupled to the integrated RF circuitry. The antenna element comprises first and second planar portions. The first planar portion is disposed in a first plane and the second planar portion is disposed in a second plane. Each of the first and second planar portions has a respective first end and a respective second end. The first and second planar portions are arranged within the respective first and second planes end-to-end with their respective first ends proximate one another. The integrated RF circuitry is disposed substantially adjacent the respective first ends of the first and second planar portions of the antenna element.

DRAWINGS

DETAILED DESCRIPTION

Figure 1:
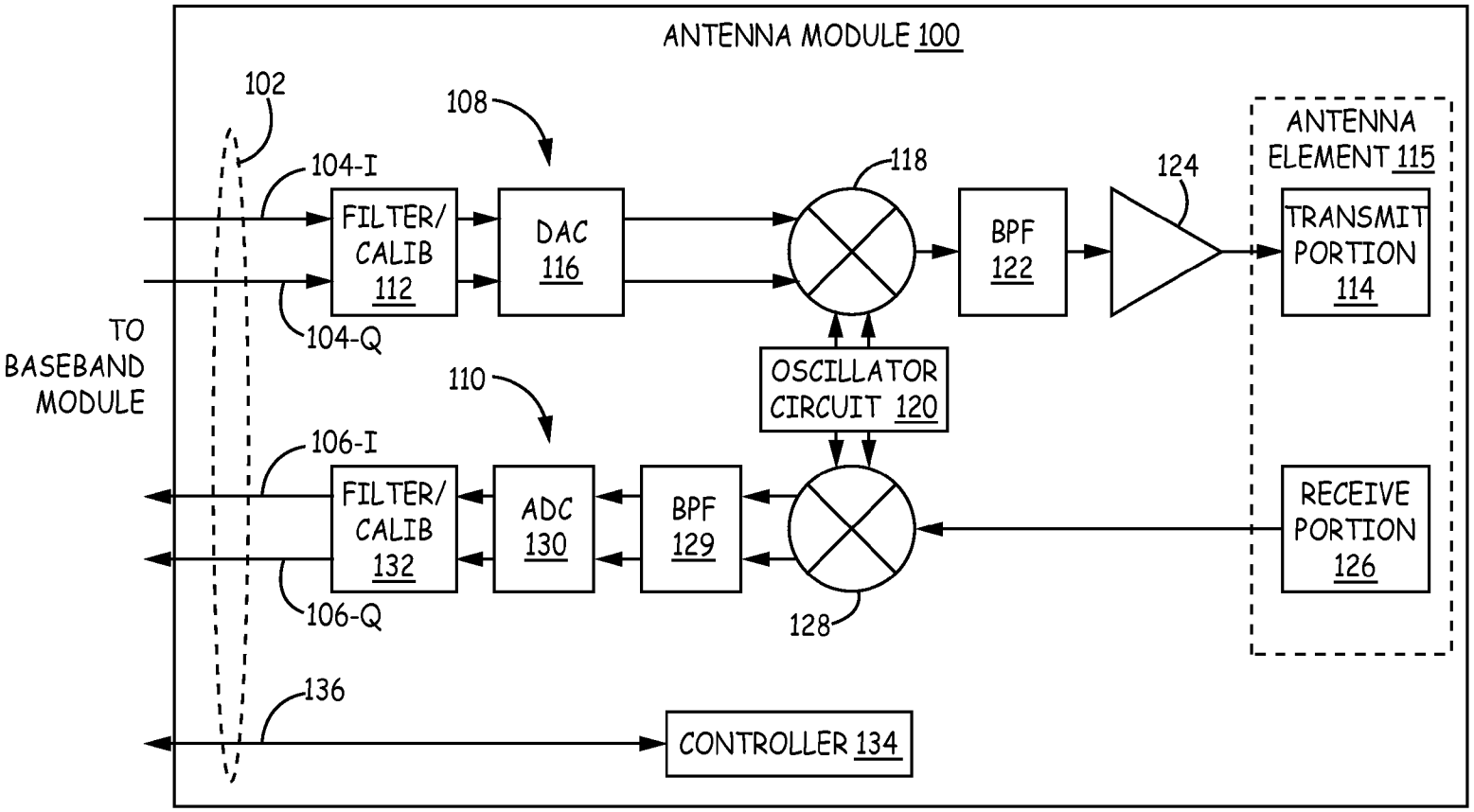
FIG. 1 is a block diagram of one exemplary embodiment of an integrated antenna module.

FIG. 1 is a block diagram of one exemplary embodiment of an integrated antenna module 100. The exemplary embodiment of the integrated antenna module 100 shown in FIG. 1 communicates with a digital baseband module (not shown) using a digital baseband interface 102. Examples of suitable digital baseband interfaces include the digital baseband interfaces specified in the Open Base Station Architecture Initiative (OBSAI) and Common Public Radio Interface (CPRI) family of standards and specifications. The digital baseband interface 102 provides an interface by which digital "transmit" baseband data 104 is provided to the antenna module 100 from the digital baseband module and by which digital "receive" baseband data 106 is provided from the antenna module 100 to the digital baseband module. In the particular exemplary embodiment described here in connection with FIG. 1, the digital transmit baseband data 104 comprises an in phase component 104-I and a quadrature-phase component 104-Q, and the digital receive baseband data 106 comprises an in-phase component 106-I and a quadrature-phase component 106-Q.

The integrated antenna unit 100 is implemented using integrated RF circuitry. The integrated RF circuitry includes a transmit path 108 (also referred to here as a "transmitter" 108) and a receive path 110 (also referred to here as the "receiver" 110).

The transmitter 108 includes a digital filter/calibration unit 112 that applies phase and/or amplitude changes to the digital transmit baseband data 104 received over the digital baseband interface 102. These applied phase and/or amplitude changes are used to create a defined phase and/or amplitude relationship between various RF signals radiated from the transmit portion 114 of an antenna element 115 of multiple antenna modules 100 in an antenna array (described below) in order to perform beam forming and/or antenna steering. The digital filter/calibration unit 112 is also configured to calibrate the transmit path 108. Calibrating the transmit path 108 involves one or more of estimating the accumulated phase and/or amplitude deviation along the transmit path 108 and the time it takes a signal to travel from the digital baseband interface 102 to the respective transmit portion 114 of the antenna element 115 (described below). The digital filter/calibration unit 112 is also configured to apply digital pre-distortion to the digital transmit baseband data 104 in order to compensate for non-linearities in the transmit path 108. In the particular exemplary embodiment described here in connection with FIG. 1, the digital filter/calibration unit 112 operates on both the in-phase and quadrature components 104-I and 104-Q of the digital transmit baseband data 104. The digital output of the digital filter/calibration unit 112 includes both in-phase and quadrature components.

In the particular exemplary embodiment described here in connection with FIG. 1, the transmit path 108 of the antenna module 100 also includes a digital-to-analog converter (DAC) 116 that converts the in-phase and quadrature components of the digital output of the digital filter/calibration unit 112 to respective analog baseband in-phase and quadrature signals. The transmit path 108 of the antenna module 100 also includes quadrature mixer 118 that mixes the analog baseband in-phase and quadrature signals output by the DAC 116 with appropriate quadrature mixing signals to produce the desired transmit RF signal. The quadrature mixing signals are produced in the conventional manner by an oscillator circuit 120. The oscillator circuit 120 is configured to phase lock a local clock signal to a reference clock and to produce the mixing signals at the desired frequency. The RF transmit signal output by the quadrature mixer 118 is bandpass filtered by bandpass filter 122 and amplified by amplifier 124.

The transmitter 108 is coupled to the transmit portion 114 of the antenna element 115 in order cause the RF transmit signal output by the transmitter 108 to be radiated from the transmit antenna element 114. In the embodiment shown in FIG. 1, the antenna element 115 that is coupled to integrated RF circuitry (that is, the transmitter 108 and receiver 110) includes a transmit portion 114 and a receive portion 126, where the transmitter 108 is coupled to the transmit portion 114 and the receiver 110 is coupled to the receive portion 126. In general, the antenna element 115 (and the portions 114 and 126 thereof) can be configured as described in the '869 Patent with the modifications and improvements described here.

The receiver 110 is coupled to the receive portion 126 of the antenna element 115 in order to receive an analog RF receive signal. In the particular exemplary embodiment described here in connection with FIG. 1, the analog RF receive signal is input to a quadrature mixer 128 that mixes the analog RF receive signal with appropriate quadrature mixing signals in order to produce analog baseband in-phase and quadrature signals. The quadrature mixing signals are produced by the oscillator circuit 120. The analog baseband in-phase and quadrature signals output by the quadrature mixer 128 are bandpass filtered by bandpass filters 129.

In the particular exemplary embodiment described here in connection with FIG. 1, the receiver 110 also includes an analog-to-digital converter (ADC) 130 that converts the analog baseband in-phase and quadrature signals to in-phase and quadrature digital receive baseband data, respectively.

The receiver 110 also includes a digital filter/calibration unit 132 that applies phase and/or amplitude changes to the digital receiver baseband data output by the ADC 130. These applied phase and/or amplitude changes are used to create a defined phase and/or amplitude relationship between various RF signals received from the receive portion 126 of the antenna element 115 of multiple antenna modules 100 in an antenna array (described below) in order to perform beam forming and/or antenna steering. The digital filter/calibration unit 132 is also configured to calibrate the receive path 110. Calibrating the receive path 110 involves one or more of estimating the accumulated phase and/or amplitude deviation along the receive path 110 and the time it takes a signal to travel from the respective receive portion 126 (described below) to the digital baseband interface 102. The digital filter/calibration unit 132 is configured to apply digital post-distortion to the digital receive baseband data in order to compensate for non-linearities in the receive path 110. In the particular exemplary embodiment described here in connection with FIG. 1, the digital filter/calibration unit 132 operates on both the in phase and quadrature components of the digital receive baseband data output by the ADC 130. The digital output of the digital filter/calibration unit 132 is the digital receive baseband data 106 that is provided to the baseband module over the digital baseband interface 102.

Multiple antenna modules 100 can be arranged together in order to form an antenna array that can be used to perform beam forming and/or antenna steering (for example, as described in the '869 Patent).

Each antenna module 100 also includes a controller 134 (or other programmable processor) that is used to control the operation of the antenna module 100 and to interact with the baseband module using a control interface 136 implemented between the antenna module 100 and the baseband module.

In the embodiment shown in FIG. 1, separate transmit and receive portions 114 and 126 of the antenna element 115 are used in order to reduce the amount of filtering required between transmit path 108 and the receive path 110. Doing so reduces the cost of the antenna module 100. Typically, a duplexer is required between the transmit path and the receive path in a frequency division duplex (FDD) system (especially where a single antenna is used for both the transmit and receive paths) in order to prevent the transmit signals from overloading the receiver or destroying the receiver. The transmit and receive portions 114 and 126 of the antenna element 115 are arranged such that some near field signal cancellation occurs between the transmitted and received signals so that the requirements for isolation and filtering are reduced.

Figure 2:
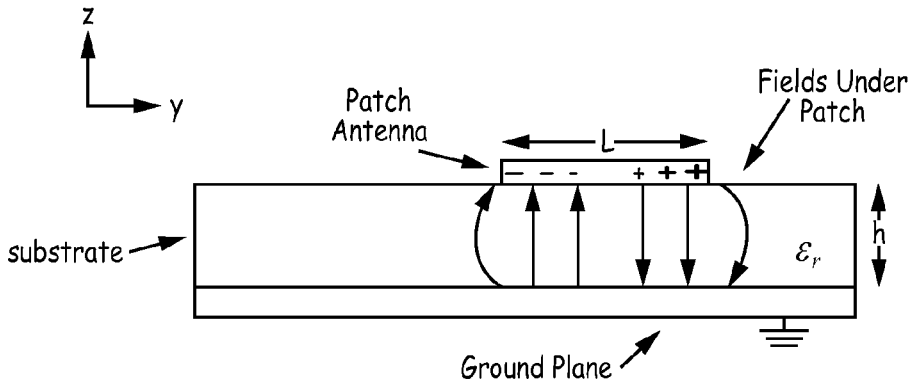
FIGS. 2-4 and 15 are diagrams illustrating examples of patch antennas.
Figure 3:
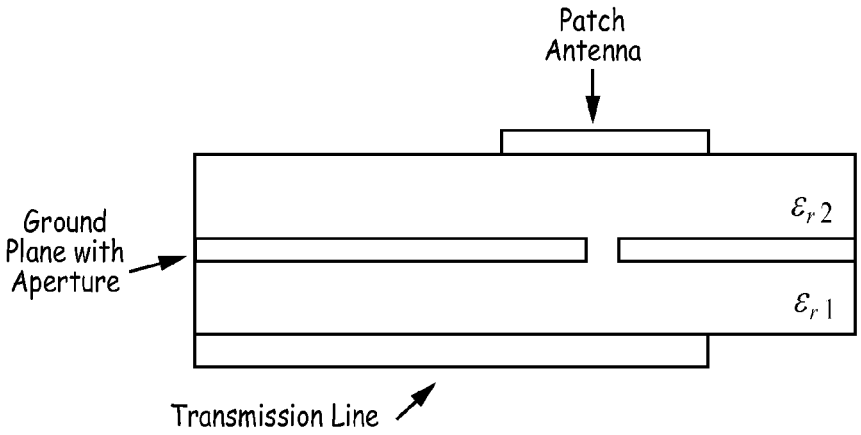
Figure 4:
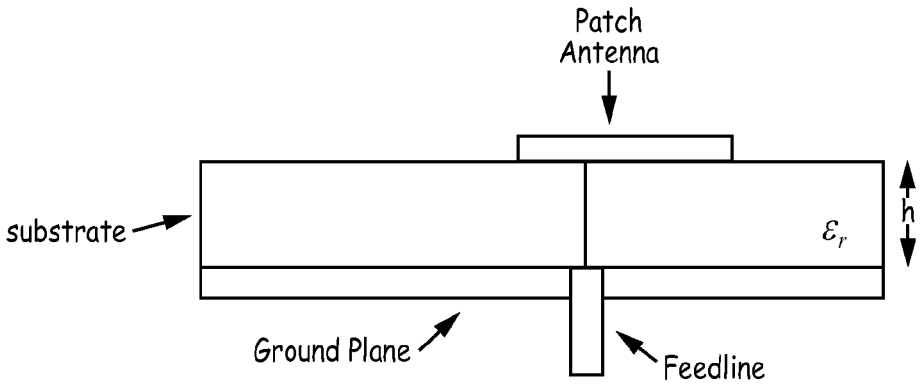

The antenna element 115 (and the transmit and receive portions 114 and 126 thereof) are typically implemented as "patch antennas", which are a subset of the planar antenna family. These patch antennas are usually comprised of a flat plate or PC board material where the antenna element is separated from a ground plane by a substrate material and fed or "excited" by connecting the transmitted signal to either the center, off-center, or even the edge of the patch. The patch radiates energy from the edges and is in effect a "leaky cavity" with all of the effective energy emitted from the edges. Most patches are square or close to square in layout with the dimensions of a side roughly ~wavelength/2. Significant work has been done with modified shapes and another version of the patch is a triangle with the two sides being the resonate edges. Patch antennas usually radiate in an omni-directional pattern above the surface of the plate, but this also means that the radiation pattern is only on the side of the ground plane that has the patch. The bottom side of the ground plane has virtually no radiation. Examples of patch antennas are shown in FIGS. 2-4.

Feeding such a patch antenna element can be done by applying a signal directly to the outer surface of the patch or through an opening in the ground plane (at, for example, the center, near-center, or end of the patch). One example of this latter approach is shown in FIG. 4. This latter approach would enable the building of circuits under the ground plane.

The transmitter 108 and the receiver 110 of the antenna module 100 can be coupled to the respective transmit and receive portions 114 and 126 of the antenna element 115 by directly connecting the output transmitter 108 or receiver 110 (for example, where the output of the transmitter 108 or input of the receiver 110 is positioned near the respective portion of the antenna element) or indirectly using an integrated transmission line (such as a stripline or a microstrip) to couple the output of the transmitter 108 or the input of the receiver 110 to the respective portion of the antenna element.

In another embodiment, the patch antenna element (and/or one or more of the portions thereof) can curve around edges to provide a desired radiation pattern. In some instances, this can help provide coverage in all directions so both the transmit and receive antenna portions cover the same area.

In general, the transmit and receive portions 114 and 126 of the antenna element 115 can be arranged in various ways.

In one exemplary embodiment, the antenna element comprises first and second substantially co-planar portions (for example, the transmit and receive portions 114 and 126 can be the first and second portions, respectively, or the second and first portions, respectively) and the integrated RF circuitry (that is, the transmitter 108 and the receiver 110) is disposed on an interior part of at least one of the first and second substantially co-planar portions.

In such an exemplary embodiment, each of the first and second substantially co-planar portions of the antenna element can have a respective first end and a respective second end, wherein the first and second substantially co-planar portions are arranged end-to-end.

In such an exemplary embodiment, the first and second substantially co-planar portions can be arranged end-to-end with their respective first ends proximate one another.

In such an exemplary embodiment, the integrated RF circuitry can be disposed on an interior part of both of the first and second substantially co-planar portions.

Figure 7:
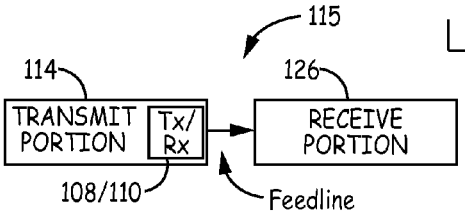
FIGS. 7-13 illustrate various embodiments of antenna elements.

In such an exemplary embodiment, the integrated RF circuitry can be completely disposed on an interior part of only the first substantially co-planar portion. The antenna module can further comprise a transmission line to operatively couple the integrated RF circuitry to the second substantially co-planar portion. One example of such an embodiment is shown in FIG. 7.

In such exemplary embodiment, the antenna module can be deployed in a distributed antenna system (for example, in the distributed antenna system described below in connection with FIG. 14).

In another exemplary embodiment, the antenna element comprises first and second substantially co-planar portions (for example, the transmit and receive portions 114 and 126 can be the first and second portions, respectively, or the second and first portions, respectively) and each of the first and second substantially co-planar portions have a first end and a second end. The integrated RF circuitry (that is, the transmitter 108 and the receiver 110) is disposed substantially adjacent to a region of the first substantially co-planar portion of the antenna element that does not include the respective first end of the first substantially co-planar portion of the antenna element.

In such an exemplary embodiment, the first and second substantially co-planar portions can be arranged end-to-end.

In such an exemplary embodiment, the first and second substantially co-planar portions can be arranged end-to-end with their respective first ends proximate one another.

In such an exemplary embodiment, the integrated RF circuitry can be disposed substantially adjacent to a respective region of the second substantially co-planar portion of the antenna element that does not include the respective first end of the second substantially co-planar portion of the antenna element.

In such an exemplary embodiment, the integrated RF circuitry can be disposed substantially adjacent to the respective second end of the first substantially co-planar portion of the antenna element.

In such an exemplary embodiment, the antenna module can further comprise a transmission line to operatively couple the integrated RF circuitry to the first substantially co-planar portion.

In such an exemplary embodiment, the transmission line can operatively couple the integrated RF circuitry to the respective first end of the first substantially co-planar portion.

In such an exemplary embodiment, the antenna module can be deployed in a distributed antenna system (for example, in the distributed antenna system described below in connection with FIG. 14).

In another exemplary embodiment, the antenna element comprises first and second substantially co-planar portions (for example, the transmit and receive portions 114 and 126 can be the first and second portions, respectively, or the second and first portions, respectively). The radio frequency transmitter is operatively coupled to the first substantially co-planar portion of the antenna element, and the radio frequency receiver is operatively coupled to the second substantially co-planar portion of the antenna element. Each of the first and second substantially co-planar portions have a first end and a second end, and the first and second substantially co-planar portions are arranged end-to-end with their respective first ends substantially separated from one another within the antenna module.

In such an exemplary embodiment, the radio frequency transmitter can be disposed substantially adjacent the respective first end of the first substantially co-planar portion of the antenna element.

In such an exemplary embodiment, the radio frequency transmitter can be directly coupled to the first substantially co-planar portion of the antenna element.

In such an exemplary embodiment, the radio frequency transmitter can be directly coupled to the first substantially co-planar portion of the antenna element without use of a separate cable or wire.

In such an exemplary embodiment, the radio frequency receiver can be disposed substantially adjacent the respective first end of the second substantially co-planar portion of the antenna element.

In such an exemplary embodiment, the radio frequency receiver can be directly coupled to the second substantially co-planar portion of the antenna element.

In such an exemplary embodiment, the radio frequency receiver can be directly coupled to the second substantially co-planar portion of the antenna element without the use of a separate cable or wire.

In such an exemplary embodiment, the antenna module can be deployed in a distributed antenna system (for example, in the distributed antenna system described below in connection with FIG. 14).

In another exemplary embodiment, the antenna element comprises first and second substantially co-planar portions (for example, the transmit and receive portions 114 and 126 can be the first and second portions, respectively, or the second and first portions, respectively) and each of the first and second substantially co-planar portions have a first end and a second end. The first and second substantially co-planar portions are arranged with their respective first ends proximate one another and offset from one another. The integrated RF circuitry (that is, the transmitter 108 and the receiver 110) is disposed substantially adjacent the respective first ends of the first and second substantially co-planar portions of the antenna element.

In such an exemplary embodiment, the antenna module can be deployed in a distributed antenna system (for example, in the distributed antenna system described below in connection with FIG. 14).

In another exemplary embodiment, the antenna element comprising first and second planar portions (for example, the transmit and receive portions 114 and 126 can be the first and second portions, respectively, or the second and first portions, respectively). The first planar portion is disposed in a first plane and the second planar portion is disposed in a second plane. Each of the first and second planar portions has a respective first end and a respective second end. The first and second planar portions are arranged within the respective first and second planes end-to-end with their respective first ends proximate one another. The integrated RF circuitry (that is, the transmitter 108 and the receiver 110) is disposed substantially adjacent the respective first ends of the first and second planar portions of the antenna element.

In such an exemplary embodiment, the antenna module can be deployed in a distributed antenna system (for example, in the distributed antenna system described below in connection with FIG. 14).

Figure 15:
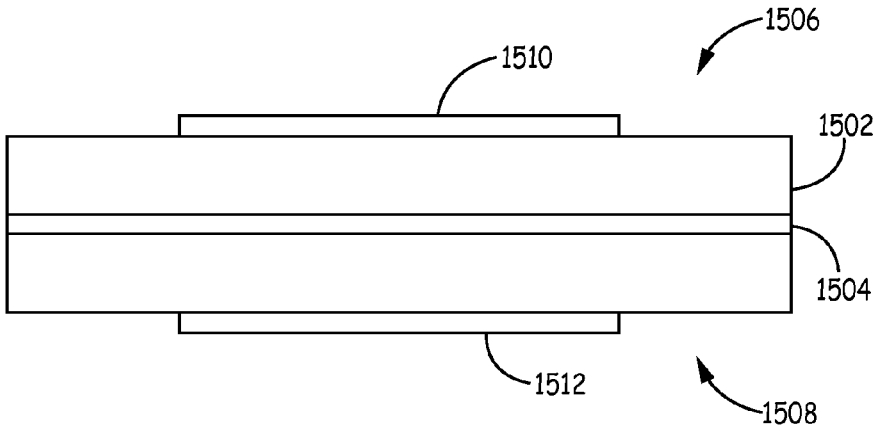

In such an exemplary embodiment (shown in FIG. 15), the antenna module can further comprise a substrate 1502 having a ground plane 1504, where the substrate 1502 has first and second opposing surfaces 1506 and 1508 separated by the ground plane 1504. The first plane in which the first planar portion 1510 of the antenna element is disposed can comprise the first surface 1506 of the substrate 1502, and the second plane in which the second planar portion 1512 of the antenna element is disposed can comprise the second surface 1508 of the substrate 1502.

In such an exemplary embodiment, the integrated RF circuitry can comprise first and second surfaces. The first plane in which the first planar portion of the antenna element is disposed can comprise the first surface of the RF circuitry. The second plane in which the second planar portion of the antenna element is disposed can comprise the second surface of the integrated RF circuitry.

Other embodiments of integrated antenna modules are possible.

Figure 5:
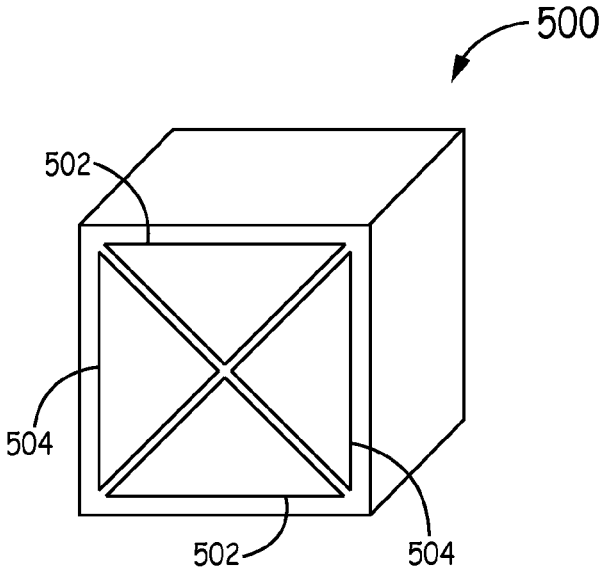
FIG. 5 illustrates one exemplary embodiment of an integrated antenna module with two transmit antenna portions and two receive antenna portions.

FIG. 5 illustrates an integrated antenna module 500 with two transmit antenna portions 502 and two receive antenna portions 504. As shown in FIG. 5, each of the antenna portions 502 and 504 is triangular. The two receive antenna portions 504 are arranged with tips of the respective triangles across from each other and pointing at each other. Likewise, the two transmit antenna portions 502 are arranged with tips of the respective triangles across from each other and pointing at each other. In some implementations, the antenna portions are configured so that radiation occurs off of the edges.

Each of the transmit antenna portions 502 is coupled to a respective integrated transmitter (for example, like the transmitter 108 described above in connection with FIG. 1) (not shown in FIG. 5), and each receive antenna portion 504 is coupled to a respective integrated receiver (for example, like the receiver 110 described above in connection with FIG. 1) (not shown in FIG. 5).

The embodiment shown in FIG. 5 can be used for MIMO applications or other multiple transmitter/receiver applications such as beam forming and antenna steering.

Also, a similar arrangement of antenna portions can be placed on more than one side (surface) of the cube structure shown in FIG. 5.

Moreover, although the triangular antenna portion arrangement is shown in FIG. 5 as being disposed on a cube structure, such a triangular antenna portion arrangement can be disposed on the surfaces of other structures—such as a substantially planar structure (for example on one or both sides of such a substantially planar structure) or a pyramid or other polyhedron (for example, on one, all, or more than one but less than all of the surfaces of such structures). Also, the triangular antenna portions can be arranged to form shapes other than squares (for example, by using more than 4 triangular antenna portions to form hexagons, larger triangles, octagons, etc.).

Also, if multiple instantiations of the module structure shown in FIG. 5 are stacked in the X and Y directions to build an array, some modules can be used for cellular RF signals, others for PCS RF signals, others for AWS RF signals. In this way, a "mix and match" multi-service antenna array can be constructed in a flexible and efficient manner. Such a stacked structure can be used to create an omnidirectional array using multiple sides of the structure to transmit and receive. Such a stacked structure can be used as a steerable array by using only a single side of the overall stacked structure to transmit and receive.

Figure 6:
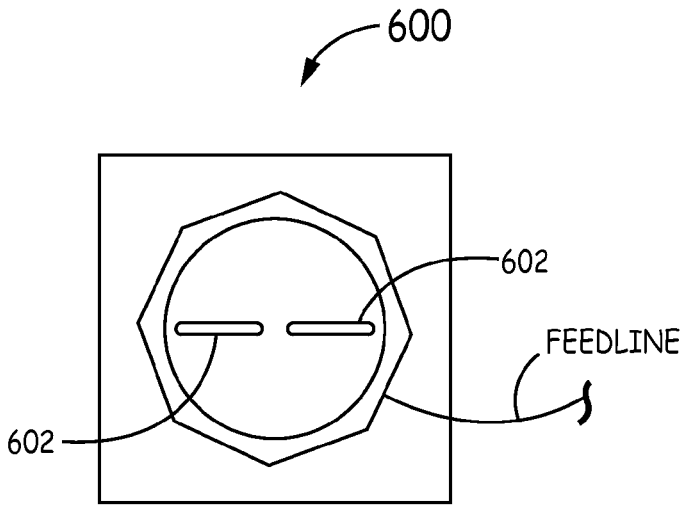
FIG. 6 illustrates one example of a circular patch antenna.

FIG. 6 illustrates one example of a circular patch antenna 600 (suitable for use, for example, as an 800 Mhz antenna). The circular patch 600 is fed in the center (though in other embodiments it is fed in other ways). Slots 602 are used to help tune it. In some implementations, the circular patch is printed on foamboard in order to be cheap. It can be used for small cells.

Figure 8:
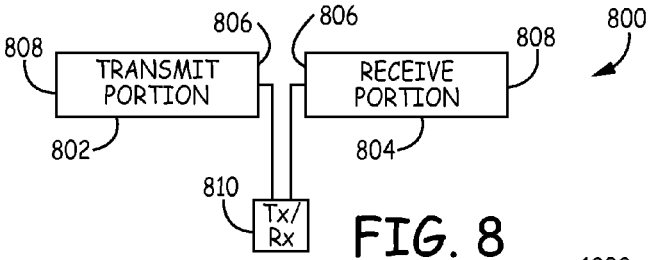

FIG. 8 illustrates an embodiment in which the antenna element 800 comprises first and second substantially co-planar portions 802 and 804 (for example, the transmit and receive portions 114 and 126 can be the first and second portions, respectively, or the second and first portions 802 and 804, respectively) and each of the first and second substantially co-planar portions 802 and 804 have a first end and a second end 806 and 808, wherein the first and second substantially co-planar portions 802 and 804 are arranged end-to-end with their respective first ends 806 proximate one another. The integrated RF circuitry 810 (that is, the transmitter 108 and the receiver 110) is disposed substantially away from the respective first ends 806 of the first and second substantially co-planar portions 802 and 804 of the antenna element 800 but operatively thereto using feed lines 812.

Figure 9:
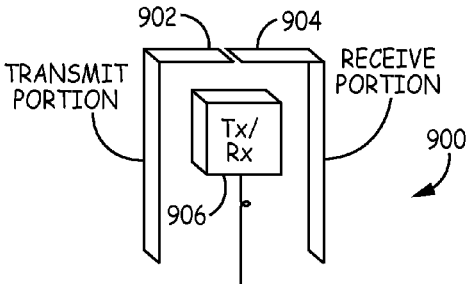

FIG. 9 illustrates an embodiment in which the antenna element 900 comprises first and second portions 902 and 904 (for example, the transmit and receive portions 114 and 126 can be the first and second portions, respectively, or the second and first portions 902 and 904, respectively) that are implemented as substantially non-planar structures. As shown in FIG. 9, each of the first and second portions 902 and 904 is implemented as a respective L-shaped structure, where each of the first and second portions 902 and 904 includes two respective planar portions. The integrated RF circuitry 906 (that is, the transmitter 108 and the receiver 110) is operatively coupled to the first and second portions 902 and 904.

Figure 10:
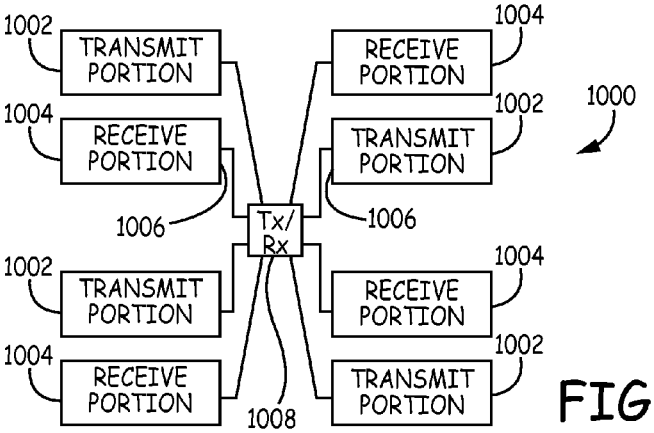

FIG. 10 illustrates an embodiment in which there are a plurality of antenna elements 1000 where each antenna element 1000 includes respective first and second portions 1002 and 1004 (for example, the transmit and receive portions 114 and 126 can be the first and second portions 1002 and 1004, respectively, or the second and first portions 1004 and 1002, respectively) that are implemented as substantially non-planar structures. Each of pair of first and second portions 1002 and 1004 are arranged as shown in FIG. 10 where their respective first ends 1006 are aligned (as opposed to being arranged end-to-end). In this embodiment, each of the multiple antenna elements 1000 can be fed by the same integrated RF circuitry 1008 (that is, transmitter and receiver) (as shown in FIG. 10) or by a different transmitter and receiver.

Figure 11:
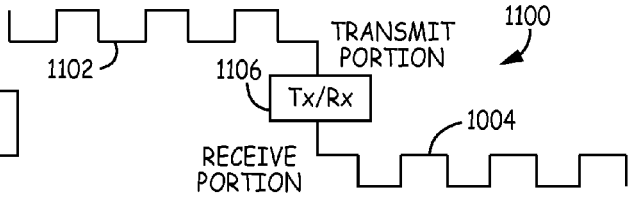

FIG. 11 illustrates an embodiment in which the first and second portions 1102 and 1104 of the antenna element 1100 are implemented as a respective meandering line. In this embodiment, the first and second portions 1102 and 1104 can be fed by the same integrated RF circuitry 1106 (that is, transmitter and receiver) (as shown in FIG. 11) or by a different transmitter and receiver.

Figure 12:
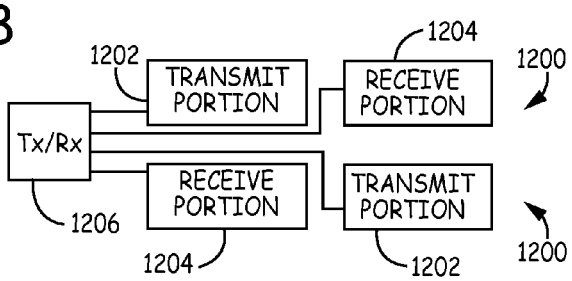

FIG. 12 illustrates an embodiment where there are multiple antenna elements 1200 (each of which having respective transmit and receive portions 1202 and 1204) where the integrated RF circuitry 1206 is located on one side of the antenna element arrangement as shown in FIG. 12. In this embodiment, each of the multiple antenna elements 1200 can be fed by the same integrated RF circuitry 1206 (that is, transmitter and receiver) (as shown in FIG. 12) or by a different transmitter and receiver.

Figure 13:
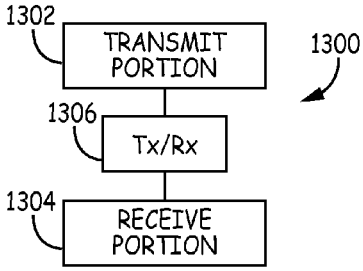

FIG. 13 illustrates an embodiment where the antenna element 1300 is configured as a center-fed dipole. In this embodiment, the transmit and receive portions 1302 and 1304 are center-fed by the integrated RF circuitry 1306.

Figure 14:
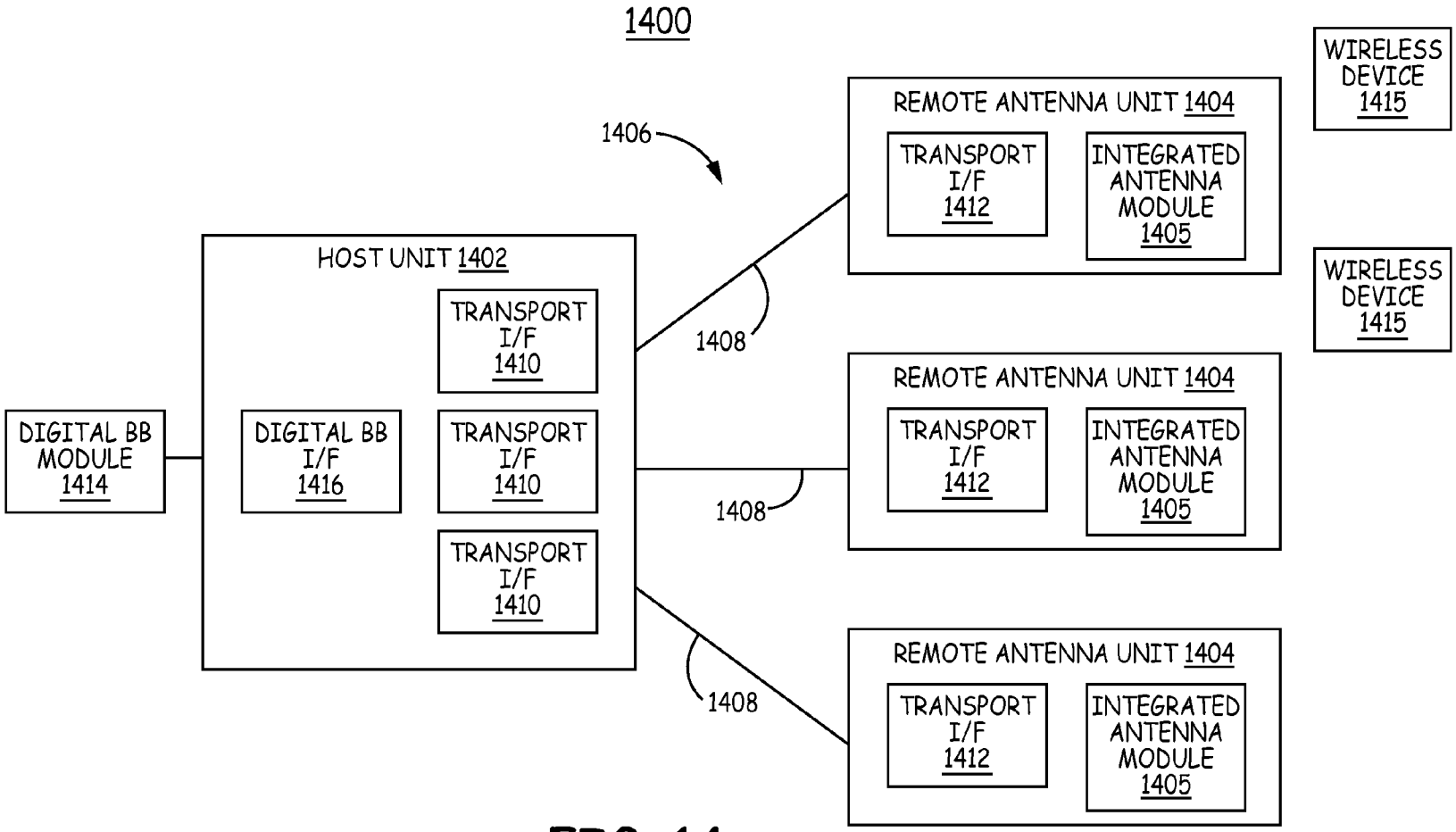
FIG. 14 is a block diagram of one exemplary embodiment of a distributed antenna system in which integrated antenna modules can be used.

FIG. 14 is a block diagram of an exemplary embodiment of a distributed antenna system 1400 in which the integrated antenna modules 1405 of the type described above can be used. In the exemplary embodiment shown in FIG. 14, the DAS 1400 includes a host unit 1402 and one or more remote antenna units 1404, each of which includes one or more integrated antenna modules 1405 of the type described above. In this example, the DAS 1400 includes one host unit 1402 and three remote antenna units 1404, though it is to be understood that other numbers of host units 1402 and/or remote antenna units 1404 can be used. Moreover, it is to be understood that the integrated antenna modules described here can be used in other DAS, repeater, or distributed base station products and systems.

In the exemplary embodiment shown in FIG. 14, the host unit 1402 is communicatively coupled to each remote antenna unit 1404 over a transport communication medium or media 1406. The transport communication media 1406 can be implemented in various ways. For example, the transport communication media 1406 can be implemented using respective separate point-to-point communication links, for example, where respective optical fiber or copper cabling is used to directly connect the host unit 1402 to each remote antenna unit 1404. One such example is shown in FIG. 14, where the host unit 1402 is directly connected to each remote antenna unit 1404 using a respective optical fiber 1408. Also, in the embodiment shown in FIG. 14, a single optical fiber 1408 is used to connect the host unit 1402 to each remote antenna unit 1404, where wave division multiplexing (WDM) is used to communicate both downstream and upstream signals over the single optical fiber 1408. In other embodiments, the host unit 1402 is directly connected to each remote antenna unit 1404 using more than one optical fiber (for example, using two optical fibers, where one optical fiber is used for communicating downstream signals and the other optical fiber is used for communicating upstream signals). Also, in other embodiments, the host unit 1402 is directly connected to one or more of the remote antenna units 1404 using other types of communication media such a coaxial cabling (for example, RG6, RG11, or RG59 coaxial cabling), twisted-pair cabling (for example, CAT-5 or CAT-6 cabling), or wireless communications (for example, microwave or free-space optical communications).

The transport communication media 1406 can also be implemented using shared point-to-multipoint communication media in addition to or instead of using point-to-point communication media. One example of such an implementation is where the host unit 1402 is directly coupled to an intermediary unit (also sometimes referred to as an "expansion" unit), which in turn is directly coupled to multiple remote antenna units 1404. Another example of a shared transport implementation is where the host unit 1402 is coupled to the remote antenna units 1404 using an Internet Protocol (IP) network.

The host unit 1402 includes one or more transport interfaces 1410 for communicating with the remote antenna units 1404 over the transport communication medium or media 1406. Also, each remote antenna unit 1404 includes at least one transport interface 1412 for communicating with the host unit 1402 over the transport communication medium or media 1406. Each of the transport interfaces 1410 and 1412 include appropriate components (such as transceivers, framers, etc.) for sending and receiving data over the particular type of transport communication media used.

In this example, the DAS 1400 is used to distribute bidirectional wireless communications between one or more digital baseband modules 1414 and one or more wireless devices 1415 (for example, mobile telephones, mobile computers, and/or combinations thereof such as personal digital assistants (PDAs) and smartphones).

The techniques described here are especially useful in connection with the distribution of wireless communications that use licensed radio frequency spectrum, such as cellular radio frequency communications. Examples of such cellular RF communications include cellular communications that support one or more of the second generation (2G), third generation (3G), and fourth generation (4G) Global System for Mobile communication (GSM) family of telephony and data specifications and standards, one or more of the second generation (2G), third generation (3G), and fourth generation (4G) Code Division Multiple Access (CDMA) family of telephony and data specifications and standards, and/or the WIMAX family of specification and standards. In other embodiments, the DAS 1400, and the improved remote antenna unit technology described here, are used with wireless communications that make use of unlicensed radio frequency spectrum such as wireless local area networking communications that support one or more of the IEEE 802.11 family of standards. In other embodiments, combinations of licensed and unlicensed radio frequency spectrum are distributed.

In the exemplary embodiment shown in FIG. 14, the host unit 1402 is communicatively coupled to one or more digital baseband modules 1414. The host unit 1402 is configured to communicate with the digital baseband modules 1414 using a digital baseband interface 1416 of the type described above. Although the digital baseband modules 1414 are shown in FIG. 14 as being separate from the host unit 1402, it is to be understood that the digital baseband modules 1414 can be integrated into the host unit 1402.

In the transmit or downstream direction (that is, from the host unit 1402 to the remote antenna units 1404), the host unit 1402 receives in-phase and quadrature digital transmit baseband data from the digital baseband modules 1414 over the digital baseband interface 1416. The host unit 1402 then distributes at least some of the received in-phase and quadrature digital transmit baseband data to one or more of the remote antenna units 1404 over the transport communication media 1406. For example, the host unit 1402 can be configured to distribute the same digital transmit baseband data to all of the remote antenna units 1404 and/or can be configured to distribute different digital transmit baseband data to the various remote antenna units 1404.

Each remote antenna unit 1404 uses its transport interface 1412 to receive the in-phase and quadrature digital transmit baseband data communicated to it. As described above, the transmitter (not shown in FIG. 14) included in each integrated antenna module 1405 is used to produce one or more analog RF transmit signals from the in-phase and quadrature digital transmit baseband data communicated to it and to radiate the produced analog RF transmit signals from the transmit portion (not shown in FIG. 14) of the antenna element or elements included in that module 1405.

In the receive or upstream direction (that is, from the remote antenna units 1404 to the host unit 1402), each remote antenna unit 1404 receives one or more analog RF receives signals via the receive portion (not shown in FIG. 14) of the antenna element or elements in each integrated antenna module 1405. The receiver (not shown in FIG. 14) in each integrated antenna module 1405 receives the analog RF receive signals and produces in-phase and quadrature digital receive baseband data from the analog RF receive signals as described above. The transport interface 1412 in each remote antenna unit 1404 is used to communicate the in-phase and quadrature digital receive baseband data to the host unit 1402 over the transport communication medium 1406.

For each remote antenna unit 1404, the host unit 1402 uses an appropriate transport interface 1414 to receive the digital receive baseband data communicated to it. For each digital baseband module 1414, the host unit 1402 provides the in-phase and quadrature digital receive baseband data received from one or more of the remote antenna units 1404 to that digital baseband module 1414 over the digital baseband interface 1416.

EXAMPLE EMBODIMENTS

Example 1 includes an antenna module comprising integrated RF circuitry comprising at least one of a transmitter and a receiver; and an antenna element operatively coupled to the integrated RF circuitry, the antenna element comprising first and second substantially co-planar portions; wherein the integrated RF circuitry is disposed on an interior part of at least one of the first and second substantially co-planar portions.

Example 2 includes the antenna module of Example 1, wherein each of the first and second substantially co-planar portions have a first end and a second end, wherein the first and second substantially co-planar portions are arranged end-to-end.

Example 3 includes the antenna module of Example 2, wherein the first and second substantially co-planar portions are arranged end-to-end with their respective first ends proximate one another.

Example 4 includes any of the antenna modules of Examples 1-3, wherein the integrated RF circuitry is disposed on an interior part of both of the first and second substantially co-planar portions.

Example 5 includes any of the antenna modules of Examples 1-4, wherein the integrated RF circuitry is completely disposed on an interior part of only the first substantially co-planar portion.

Example 6 includes the antenna module of Example 5, further comprising a transmission line to operatively couple the integrated RF circuitry to the second substantially co-planar portion.

Example 7 includes any of the antenna modules of Examples 1-6, wherein the antenna module is deployed in a distributed antenna system.

Example 8 includes an antenna module comprising: integrated RF circuitry comprising at least one of a transmitter and a receiver; and an antenna element operatively coupled to the integrated RF circuitry, the antenna element comprising first and second substantially co-planar portions; wherein each of the first and second substantially co-planar portions has a first end and a second end; and wherein the integrated RF circuitry is disposed substantially adjacent to a region of the first substantially co-planar portion of the antenna element that does not include the respective first end of the first substantially co-planar portion of the antenna element.

Example 9 includes the antenna module of Example 8, wherein the first and second substantially co-planar portions are arranged end-to-end.

Example 10 includes the antenna module of Example 9, wherein the first and second substantially co-planar portions are arranged end-to-end with their respective first ends proximate one another.

Example 11 includes any of the antenna modules of Examples 8-10, wherein the integrated RF circuitry is disposed substantially adjacent to a respective region of the second substantially co-planar portion of the antenna element that does not include the respective first end of the second substantially co-planar portion of the antenna element.

Example 12 includes any of the antenna modules of Examples 8-11, wherein the integrated RF circuitry is disposed substantially adjacent to the respective second end of the first substantially co-planar portion of the antenna element.

Example 13 includes any of the antenna modules of Examples 8-12, further comprising a transmission line to operatively couple the integrated RF circuitry to the first substantially co-planar portion.

Example 14 includes the antenna module of Example 13, wherein the transmission line operatively couples the integrated RF circuitry to the respective first end of the first substantially co-planar portion.

Example 15 includes any of the antenna modules of Examples 8-14, wherein the antenna module is deployed in a distributed antenna system.

Example 16 includes an antenna module comprising: a radio frequency transmitter; a radio frequency receiver; and an antenna element operatively coupled to the radio frequency transmitter and radio frequency receiver; wherein the antenna element comprising first and second substantially co-planar portions; wherein the radio frequency transmitter is operatively coupled to the first substantially co-planar portion of the antenna element; wherein the radio frequency receiver is operatively coupled to the second substantially co-planar portion of the antenna element; wherein each of the first and second substantially co-planar portions has a first end and a second end; and wherein the first and second substantially co-planar portions are arranged end-to-end with their respective first ends substantially separated from one another within the antenna module.

Examples 17 includes the antenna module of Example 16, wherein the radio frequency transmitter is disposed substantially adjacent the respective first end of the first substantially co-planar portion of the antenna element.

Example 18 includes any of the antenna modules of Examples 16-17, wherein the radio frequency transmitter is directly coupled to the first substantially co-planar portion of the antenna element.

Example 19 includes the antenna module of Example 18, wherein the radio frequency transmitter is directly coupled to the first substantially co-planar portion of the antenna element without the use of a separate cable or wire.

Example 20 includes any of the antenna modules of Examples 16-19, wherein the radio frequency receiver is disposed substantially adjacent the respective first end of the second substantially co-planar portion of the antenna element.

Example 21 includes any of the antenna modules of Examples 16-20, wherein the radio frequency receiver is directly coupled to the second substantially co-planar portion of the antenna element.

Example 22 includes any of the antenna modules of Examples 16-21, wherein the radio frequency receiver is directly coupled to the second substantially co-planar portion of the antenna element without the use of a separate cable or wire.

Example 23 includes any of the antenna modules of Examples 16-22, wherein the antenna module is deployed in a distributed antenna system.

Example 24 includes an antenna module comprising: integrated RF circuitry comprising at least one of a transmitter and a receiver; and an antenna element operatively coupled to the integrated RF circuitry, the antenna element comprising first and second substantially co-planar portions; wherein each of the first and second substantially co-planar portions has a first end and a second end; wherein the first and second substantially co-planar portions are arranged with their respective first ends proximate one another and offset from one another; and wherein the integrated RF circuitry is disposed substantially adjacent the respective first ends of the first and second substantially co-planar portions of the antenna element.

Example 25 includes the antenna module of Example 24, wherein the antenna module is deployed in a distributed antenna system.

Example 26 includes a radio frequency (RF) module for use in a communication device of a communication system, the module comprising integrated RF circuitry comprising at least one of a transmitter and a receiver; and an antenna element operatively coupled to the integrated RF circuitry; wherein the antenna element comprises first and second planar portions, wherein the first planar portion is disposed in a first plane and the second planar portion is disposed in a second plane; wherein each of the first and second planar portions has a respective first end and a respective second end; wherein the first and second planar portions are arranged within the respective first and second planes end-to-end with their respective first ends proximate one another; wherein the integrated RF circuitry is disposed substantially adjacent the respective first ends of the first and second planar portions of the antenna element.

Example 27 includes the antenna module of Example 26, wherein the antenna module is deployed in a distributed antenna system.

Example 28 includes any of the antenna modules of Examples 26-27, further comprising a substrate having a ground plane, wherein the substrate has first and second opposing surfaces separated by the ground plane, wherein the first plane in which the first planar portion of the antenna element is disposed comprises the first surface of the substrate, and wherein the second plane in which the second planar portion of the antenna element is disposed comprises the second surface of the substrate.

Example 29 includes any of the antenna modules of Examples 26-28, wherein the integrated RF circuitry comprises first and second surfaces, wherein the first plane in which the first planar portion of the antenna element is disposed comprises the first surface of the RF circuitry, and wherein the second plane in which the second planar portion of the antenna element is disposed comprises the second surface of the integrated RF circuitry.

Also, other examples include combinations of the individual features of the above-described Examples.

A number of embodiments have been described. Nevertheless, it will be understood that various modifications to the described embodiments may be made without departing from the spirit and scope of the claimed invention. Also, combinations of the individual features of the above-described embodiments are considered within the scope of the inventions disclosed here.

The invention claimed is:

1. An antenna module comprising:

integrated RF circuitry comprising at least one of a transmitter and a receiver; and an antenna element operatively coupled to the integrated RF circuitry, the antenna element comprising first and second substantially co-planar portions;

wherein the integrated RF circuitry is disposed on an interior part of at least one of the first and second substantially co-planar portions.

2. The antenna module of claim 1, wherein each of the first and second substantially co-planar portions have a first end and a second end, wherein the first and second substantially co-planar portions are arranged end-to-end.

3. The antenna module of claim 2, wherein the first and second substantially co-planar portions are arranged end-to-end with their respective first ends proximate one another.

4. The antenna module of claim 1, wherein the integrated RF circuitry is disposed on an interior part of both of the first and second substantially co-planar portions.

5. The antenna module of claim 1, wherein the integrated RF circuitry is completely disposed on an interior part of only the first substantially co-planar portion.

6. The antenna module of claim 5, further comprising a transmission line to operatively couple the integrated RF circuitry to the second substantially co-planar portion.

7. The antenna module of claim 1, wherein the antenna module is deployed in a distributed antenna system.

8. An antenna module comprising:

integrated RF circuitry comprising at least one of a transmitter and a receiver; and an antenna element operatively coupled to the integrated RF circuitry, the antenna element comprising first and second substantially co-planar portions;

wherein each of the first and second substantially co-planar portions has a first end and a second end; and wherein the integrated RF circuitry is disposed substantially adjacent to a region of the first substantially co-planar portion of the antenna element that does not include the respective first end of the first substantially co-planar portion of the antenna element.

9. The antenna module of claim 8, wherein the first and second substantially co-planar portions are arranged end-to-end.

10. The antenna module of claim 9, wherein the first and second substantially co-planar portions are arranged end-to-end with their respective first ends proximate one another.

11. The antenna module of claim 8, wherein the integrated RF circuitry is disposed substantially adjacent to a respective region of the second substantially co-planar portion of the antenna element that does not include the respective first end of the second substantially co-planar portion of the antenna element.

12. The antenna module of claim 8, wherein the integrated RF circuitry is disposed substantially adjacent to the respective second end of the first substantially co-planar portion of the antenna element.

13. The antenna module of claim 8, further comprising a transmission line to operatively couple the integrated RF circuitry to the first substantially co-planar portion.

14. The antenna module of claim 13, wherein the transmission line operatively couples the integrated RF circuitry to the respective first end of the first substantially co-planar portion.

15. The antenna module of claim 8, wherein the antenna module is deployed in a distributed antenna system.

16. An antenna module comprising:

a radio frequency transmitter;

a radio frequency receiver; and an antenna element operatively coupled to the radio frequency transmitter and radio frequency receiver;

wherein the antenna element comprising first and second substantially co-planar portions;

wherein the radio frequency transmitter is operatively coupled to the first substantially co-planar portion of the antenna element;

wherein the radio frequency receiver is operatively coupled to the second substantially co-planar portion of the antenna element;

wherein each of the first and second substantially co-planar portions has a first end and a second end; and wherein the first and second substantially co-planar portions are arranged end-to-end with their respective first ends substantially separated from one another within the antenna module.

17. The antenna module of claim 16, wherein the radio frequency transmitter is disposed substantially adjacent the respective first end of the first substantially co-planar portion of the antenna element.

18. The antenna module of claim 16, wherein the radio frequency transmitter is directly coupled to the first substantially co-planar portion of the antenna element.

19. The antenna module of claim 18, wherein the radio frequency transmitter is directly coupled to the first substantially co-planar portion of the antenna element without the use of a separate cable or wire.

20. The antenna module of claim 16, wherein the radio frequency receiver is disposed substantially adjacent the respective first end of the second substantially co-planar portion of the antenna element.

21. The antenna module of claim 16, wherein the radio frequency receiver is directly coupled to the second substantially co-planar portion of the antenna element.

22. The antenna module of claim 16, wherein the radio frequency receiver is directly coupled to the second substantially co-planar portion of the antenna element without the use of a separate cable or wire.

23. The antenna module of claim 16, wherein the antenna module is deployed in a distributed antenna system.

24. An antenna module comprising:

integrated RF circuitry comprising at least one of a transmitter and a receiver; and an antenna element operatively coupled to the integrated RF circuitry, the antenna element comprising first and second substantially co-planar portions;

wherein each of the first and second substantially co-planar portions has a first end and a second end;

wherein the first and second substantially co-planar portions are arranged with their respective first ends proximate one another and offset from one another; and wherein the integrated RF circuitry is disposed substantially adjacent the respective first ends of the first and second substantially co-planar portions of the antenna element.

25. The antenna module of claim 24, wherein the antenna module is deployed in a distributed antenna system.

26. A radio frequency (RF) module for use in a communication device of a communication system, the module comprising:

integrated RF circuitry comprising at least one of a transmitter and a receiver; and an antenna element operatively coupled to the integrated RF circuitry;

wherein the antenna element comprises first and second planar portions, wherein the first planar portion is disposed in a first plane and the second planar portion is disposed in a second plane;

wherein each of the first and second planar portions has a respective first end and a respective second end;

wherein the first and second planar portions are arranged within the respective first and second planes end-to-end with their respective first ends proximate one another;

wherein the integrated RF circuitry is disposed substantially adjacent the respective first ends of the first and second planar portions of the antenna element.

27. The antenna module of claim 26, wherein the antenna module is deployed in a distributed antenna system.

28. The antenna module of claim 26, further comprising a substrate having a ground plane, wherein the substrate has first and second opposing surfaces separated by the ground plane, wherein the first plane in which the first planar portion of the antenna element is disposed comprises the first surface of the substrate, and wherein the second plane in which the second planar portion of the antenna element is disposed comprises the second surface of the substrate.

29. The antenna module of claim 26, wherein the integrated RF circuitry comprises first and second surfaces, wherein the first plane in which the first planar portion of the antenna element is disposed comprises the first surface of the RF circuitry, and wherein the second plane in which the second planar portion of the antenna element is disposed comprises the second surface of the integrated RF circuitry.

* * * * *